US012044082B2

(12) United States Patent
De Mul et al.

(10) Patent No.: US 12,044,082 B2
(45) Date of Patent: Jul. 23, 2024

(54) STABBING GUIDE AND AN OPERATING METHOD

(71) Applicant: ITREC B.V., Schiedam (NL)

(72) Inventors: Arthur Alexander De Mul, Schiedam (NL); David Roodenburg, Schiedam (NL)

(73) Assignee: ITREC B.V., Schiedam (NL)

( * ) Notice: Subject to any disclaimer, the term of this patent is extended or adjusted under 35 U.S.C. 154(b) by 81 days.

(21) Appl. No.: 17/797,911

(22) PCT Filed: Feb. 5, 2021

(86) PCT No.: PCT/EP2021/052853
§ 371 (c)(1),
(2) Date: Aug. 5, 2022

(87) PCT Pub. No.: WO2021/156468
PCT Pub. Date: Aug. 12, 2021

(65) Prior Publication Data

US 2023/0073941 A1 Mar. 9, 2023

(30) Foreign Application Priority Data

Feb. 7, 2020 (EP) ..... 20156265
Feb. 19, 2020 (NL) ..... 2024941

(51) Int. Cl.
*E21B 19/16* (2006.01)
*E21B 19/06* (2006.01)
*E21B 19/24* (2006.01)

(52) U.S. Cl.
CPC ..... *E21B 19/16* (2013.01); *E21B 19/06* (2013.01); *E21B 19/24* (2013.01)

(58) Field of Classification Search
CPC ..... E21B 19/24; E21B 19/16; E21B 19/161–19/164; E21B 19/06
See application file for complete search history.

(56) References Cited

U.S. PATENT DOCUMENTS

2004/0049905 A1* 3/2004 Jansch ..... E21B 19/165 29/428
2012/0168227 A1 7/2012 Littlely et al.
(Continued)

FOREIGN PATENT DOCUMENTS

GB 2 348 844 A 10/2000
WO WO 2015/019117 A2 2/2015
(Continued)

OTHER PUBLICATIONS

Dictionary definition of "clamping" accessed Dec. 21, 2023 via thefreedictionary.com.*
(Continued)

*Primary Examiner* — Blake Michener
(74) *Attorney, Agent, or Firm* — Birch, Stewart, Kolasch & Birch, LLP

(57) ABSTRACT

A stabbing guide for tubulars, including a body; a plurality of guide members moveably supported by the body to receive a tubular and to move relative to the body between an open position and a closed position; and an actuation mechanism configured to be operated to move the plurality of guide members between the open and closed positions, wherein the body is configured to be held by a tubular connection tool.

10 Claims, 5 Drawing Sheets

(56) References Cited

U.S. PATENT DOCUMENTS

Figure 1:
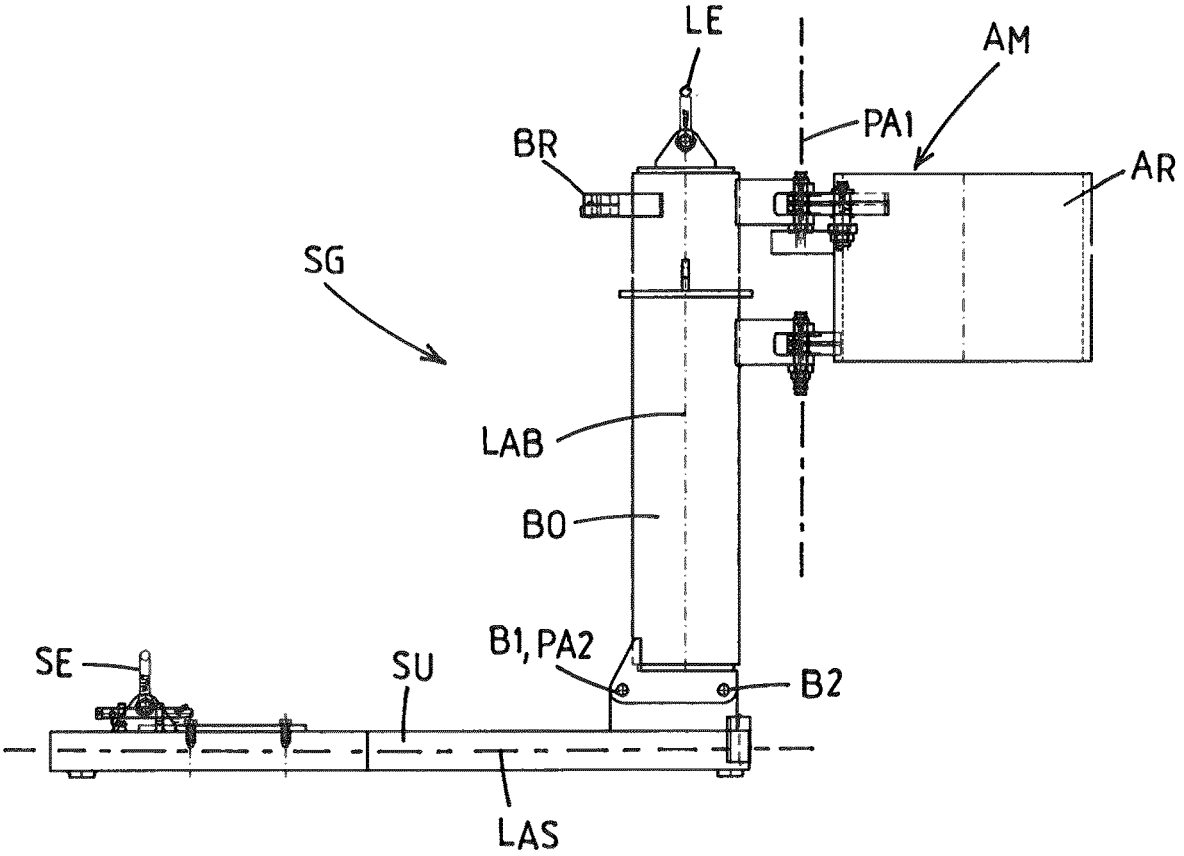

| | | | | |
|---|---|---|---|---|
| 2015/0176349 | A1* | 6/2015 | Belik | E21B 17/02 285/27 |
| 2015/0354297 | A1* | 12/2015 | Arp | E21B 19/24 166/77.51 |
| 2016/0186510 | A1* | 6/2016 | Vestersjo | E21B 19/00 166/380 |
| 2019/0277100 | A1 | 9/2019 | Thiemann et al. | |
| 2019/0284885 | A1* | 9/2019 | Soyland | E21B 19/16 |
| 2022/0065054 | A1* | 3/2022 | Mikalsen | E21B 19/16 |
| 2023/0003090 | A1* | 1/2023 | Saunders | E21B 19/24 |

FOREIGN PATENT DOCUMENTS

| | | | |
|---|---|---|---|
| WO | WO 2015/019117 | A3 | 2/2015 |
| WO | WO 2017/044482 | A1 | 3/2017 |
| WO | WO 2019/174691 | A1 | 9/2019 |

OTHER PUBLICATIONS

"Mechanized Stabbing Guide," Tech Specs, Weatherford, Dec. 31, 2015, total 1 page.

International Search Report (PCT/ISA/210) issued in PCT/EP2021/052853, dated Mar. 12, 2021.

Search Report and Written Opinion for NL Application No. 2024941, dated Oct. 19, 2020.

Written Opinion of the International Searching Authority (PCT/ISA/237) issued in PCT/EP2021/052853, dated Mar. 12, 2021.

* cited by examiner

STABBING GUIDE AND AN OPERATING METHOD

The invention relates to a stabbing guide for tubulars and a method for operating a stabbing guide, as used, for example, in the oil and gas industry when making-up a tubular string.

In the oil and gas industry, and in other industries where bores are drilled in the earth to access subsurface regions, many operations require the assembly or disassembly of long strings of tubulars. Examples of such tubular strings are a drill string formed of a plurality of drill pipes with a drill bit mounted on the distal end of the drill string, and a casing string formed of a plurality of casings.

Generally, the tubulars, e.g. the drill pipes or casings, have a threaded male or pin connection on a leading end and a threaded female or box connection on a trailing end. A tubular string is made up by adding tubulars to the upper end of the existing string that meanwhile is supported and held in or below the drill floor with only a short length of tubular, e.g. the "stick-up", extending from the drill floor. A tubular to be added is then lifted and manipulated to bring the male connection on the lower end of the tubular towards the female connection on the upper end of the stick-up. As the male and female connection are brought together, it is conventional to locate a stabbing guide on or around the female connection to guide the male connection into alignment with the female connection, thereby protecting the end surfaces and threads from damage.

A prior art example of a stabbing guide is disclosed in EP3030742. The shown stabbing guide has the advantage that manual location and manipulation is reduced by using a mounting frame that is pivotable between a retracted location, in which the guide members are spaced from the stick-up, and an active location, in which the guide members surround the upper end of the stick-up. However, a drawback is that the flexibility of the relatively large stabbing guide including mounting frame is reduced due to the increased size and weight.

Hence, it is an object of the invention to provide a stabbing guide that can easily be handled and operated while maintaining the advantage of reduced manual intervention.

According to a first aspect of the invention there is provided a stabbing guide for tubulars, comprising:

a body;

a plurality of guide members moveably supported by the body to receive a tubular and to move relative to the body between an open position and a closed position; and an actuation mechanism configured to be operated to move the plurality of guide members between the open and closed positions, wherein the body is configured to be held by a tubular connection tool.

And advantage of using the tubular connection tool is that no or at least minimal manual location and operation is required as the tubular connection tool can be used for moving the stabbing guide around and that this does not require an additional tool so that space is saved. The stabbing guide can also be made smaller and lighter as no mounting frame and/or positioning means are required as part of the stabbing guide. These are all provided by the tubular connection tool.

A tubular connection tool such as a power tong or roughneck is common practice to use to make a connection between two tubulars by torqueing the connection up to a predetermined torque. Generally speaking, a tubular connection tool is configured to make up or break out a connection between two tubulars by applying a relative rotation to the two tubulars. The tubular connection tool is usually located on a platform of the drill floor, either on rails, or hung from a derrick on a chain. In order to make up or break out a threaded connection, a two tong arrangement is preferred. An active (or wrenching) tong supplies torque to the section of tubular above the threaded connection, while a passive (or backup) tong supplies a reaction torque below the threaded connection. The backup tong clamps the tubular below the threaded connection and prevents it from rotating. This clamping can be performed mechanically, hydraulically or pneumatically. The wrenching tong clamps the tubular above the threaded connection and is driven so that it supplies torque for a limited angle. Both tongs are preferably used to hold the body of the stabbing guide when the stabbing guide is used to align two tubulars or in case only one of the tongs is used to hold the body of the stabbing guide, the other tong is no longer usable for connection purposes. Further, it is preferred that no structural adaptations are required to allow the tubular connection tool hold the body of the stabbing guide, meaning that the tubular connection tool can be used as if holding two tubulars for connecting, but instead holds the body of the stabbing guide. In other words, when solely removing the stabbing guide, the tubular connection tool is suitable for connecting two tubulars.

Although prior art document WO2017/044482A1 discloses a robot arm configured to hold a plurality of tools, including a clamp to hold a tubular and tools to be exchanged with the top drive unit, the robot arm is not used to make up or break out a connection between two tubulars and there is no disclosure of a stabbing guide to be held by the robot arm.

Further, although the prior art document WO2019/174691A1 discloses a robot arm with stabbing guide, the robot arm holding the stabbing guide cannot be used to connect two tubulars when the stabbing guide is removed from the robot arm.

In an embodiment, the body has a tubular shape, which makes it easier for a tubular connection tool to hold the stabbing guide as the body mimics a tubular.

In an embodiment, the stabbing guide further comprises a support allowing to position the stabbing guide on a flat surface when the stabbing guide is not held by the tubular connection tool. This has the advantage that the tubular connection tool is able to easily grab and put back the stabbing guide from a storage location during operation without any or minimal manual intervention. Alternatively, a hoisting device maybe used to easily transport the stabbing guide between the tubular connection tool and a storage location.

In an embodiment, the stabbing guide is provided with two guide members, each guide member being pivotable about a respective pivot axis between an open position and a closed position. Preferably, the respective pivot axes extend parallel to a longitudinal axis of the tubulars, i.e. parallel to a longitudinal axis of the body held by the tubular connection tool, which preferably extend vertically. The two pivot axes preferably coincide. An advantage of this configuration is that only two simple and easy actuatable motions need to be performed to close or open the stabbing guide. This is in contrast to prior art document EP3030742, where a total of four guiding elements are disclosed, each having their own actuation mechanism.

In an embodiment, the two guide members have a shape corresponding to a circle sector with a cutaway for receiving a portion of a tubular, seen in plan view, wherein preferably, the circle sector spans an angular range in between 90 and 180 degrees, preferably between 100 and 170 degrees, more preferably between 120 and 175 degrees, and most preferably between 150 and 160 degrees.

In an embodiment, the stabbing guide is configured to be used with at least two types of tubulars having a different diameter, so that preferably the guide members are releasably connected to the actuation mechanism to allow the guide members to be replaced by another set of guide members corresponding to a different tubular diameter.

In an embodiment, a locking mechanism is provided to lock the guide members to the actuation mechanism during use, so that the guide members do not inadvertently release from the actuation mechanism during operation thereof.

Actuators can be provided on the stabbing guide, but an embodiment wherein additionally or alternatively the actuation mechanism is operable using external actuators is also envisaged.

In an embodiment, the actuation mechanism includes at least one actuator arranged between the body and at least one of the guide members to move the at least one guide member between the open an closed positions. Power may be provided to the at least one actuator using a battery as part of the stabbing guide, but may also originate externally, e.g. in the form of an electricity line to a mains or external generator or in the form of hydraulic lines.

In an embodiment, the actuation mechanism includes a portion configured to engage with the tubular connection tool such that actuation of the tubular connection tool is able to move at least one guide member between the open and closed positions via the actuation mechanism. Preferably, the tubular connection tool is able to actuate all guide members, so that no external power and actuators on the stabbing guide are required for operation.

In an embodiment, the actuation mechanism includes a circular shaped element—seen in pan view, i.e. a cylindrical or ring shaped element—rotatably arranged around a tubular shaped body, wherein the body is configured to be held by a passive tong of the tubular connection tool, wherein the circular shaped element is configured to engage with an active tong of the tubular connection tool, and wherein the actuation mechanism is configured to transfer rotational movement of the circular shaped element to movement of the guide members between the open and closed position.

In an embodiment, the stabbing guide is configured to operate on casing tubulars. The stabbing guide may then be referred to as casing stabbing guide.

In an embodiment, the support configured to position the stabbing guide on a flat surface when the stabbing guide is not held by the tubular connection tool is connected to a lower part of the body. Preferably, the body is pivotable relative to the support about a corresponding support pivot axis allowing the body to move between an active orientation substantially perpendicular to the support and a transport orientation substantially parallel to the support.

The first aspect of the invention also relates to a method for using the stabbing guide according to the first aspect of the invention, wherein the method comprises the following steps starting from a situation in which the stabbing guide is at a distance from a firing line:

a. arranging the body of the stabbing guide in a tubular connection tool;

b. providing the guide members in the open position;

c. moving the stabbing guide to a position such that the guide members—while being in the open position—surround a free end of a tubular in the firing line; and d. moving the guide members to the closed position.

In an embodiment, steps b. and d. are carried out by actuators arranged on the stabbing guide.

In an embodiment, steps b. and d. are carried out by actuators of the tubular connection tool.

In an embodiment, the tubular connection tool comprises a passive tong and an active tong, wherein the passive tong is used to hold the body of the stabbing guide, and wherein the active tong is used to carry out steps b. and d.

It is explicitly noted here that features and embodiments described in relation to the stabbing guide may readily be combined with the method for using the stabbing guide, where possible and appropriate.

According to a second aspect of the invention, there is provided a stabbing guide for tubulars, comprising:

a body;

two guide members moveably supported by the body to receive a tubular and to move relative to the body between an open position and a closed position; and an actuation mechanism configured to be operated to move the plurality of guide members between the open and closed positions, wherein each guide member is pivotable about a respective pivot axis between the open position and the closed position.

In an embodiment, the pivot axes of the two guide members coincide.

In an embodiment, the two guide members have a shape corresponding to a circle sector with a cutaway for receiving a portion of a tubular, wherein preferably, the circle sector spans an angular range in between 90 and 180 degrees.

It is explicitly noted here that features and embodiments described in relationship to the first aspect of the invention may readily be combined with the stabbing guide according to the second aspect of the invention where possible and appropriate.

Figure 3:
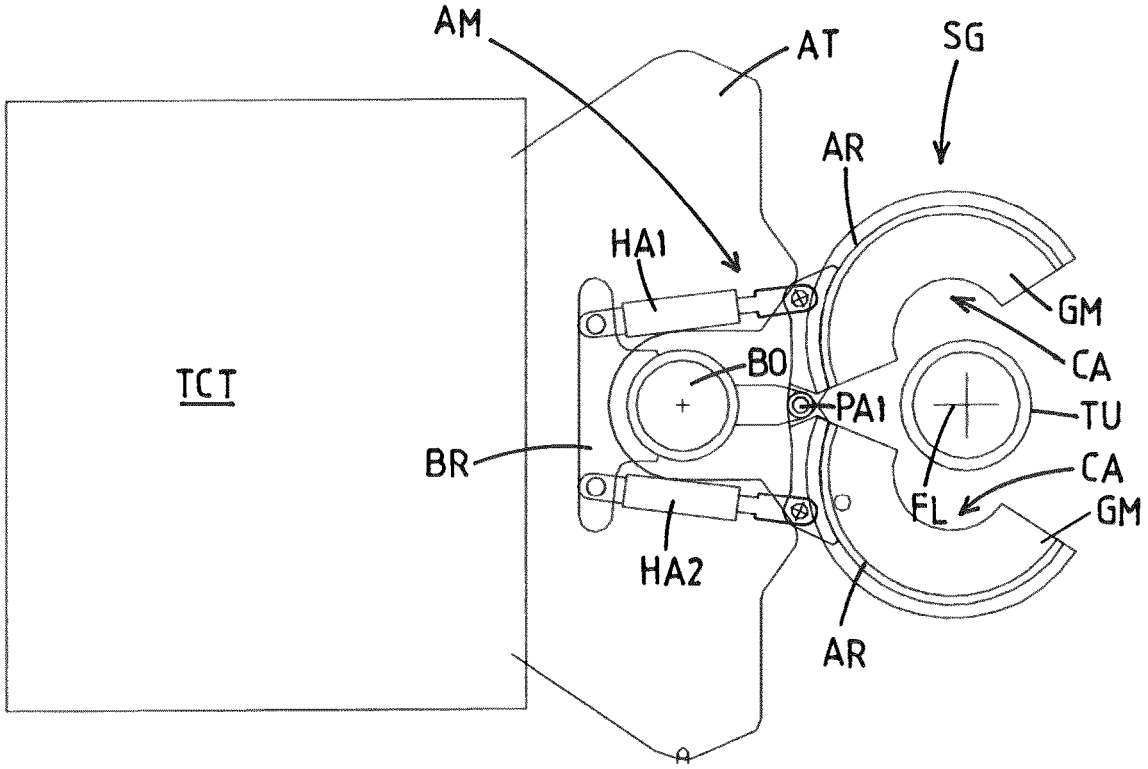
Figure 2:
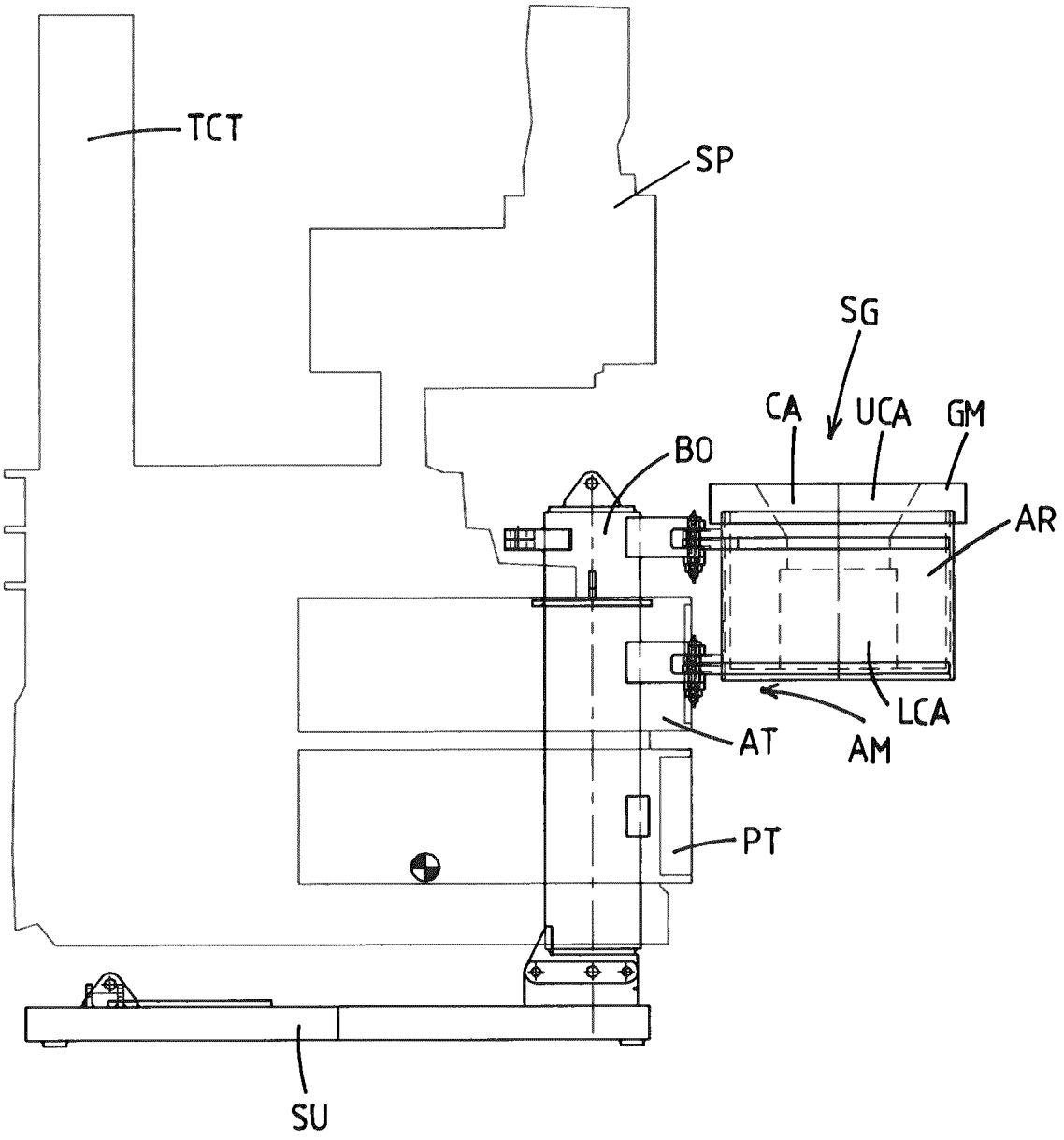
Figure 4:
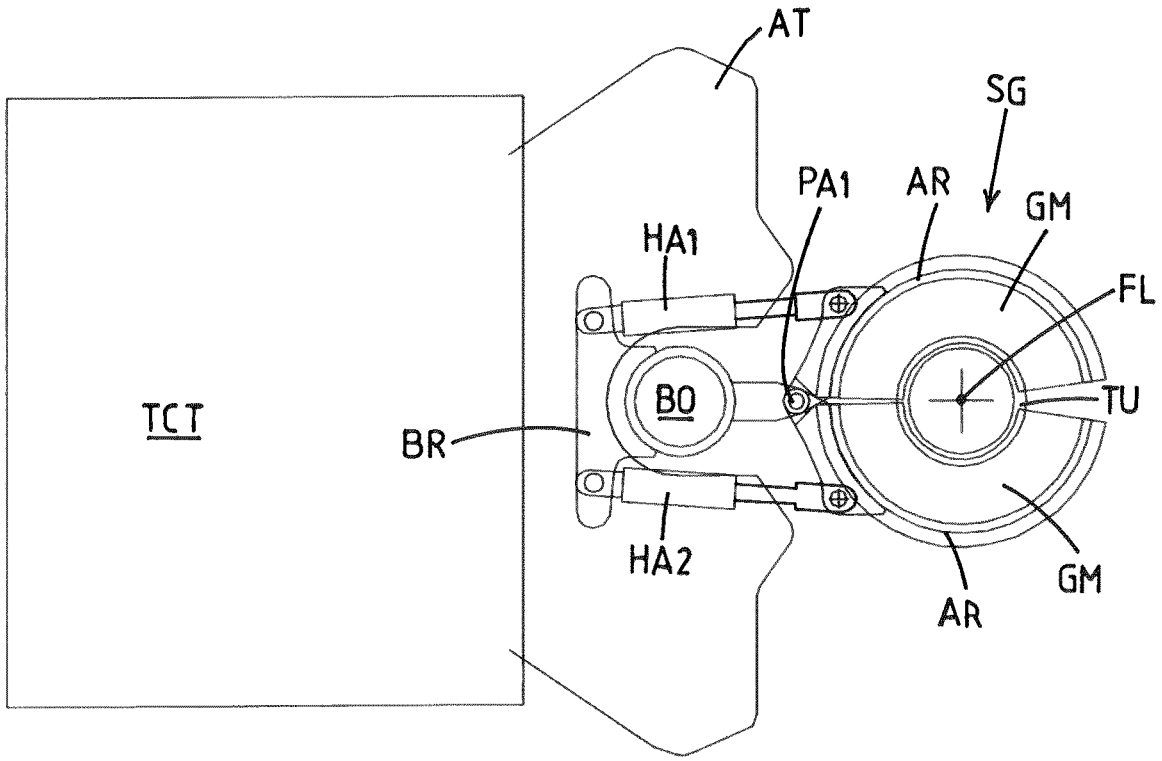
Figure 6:
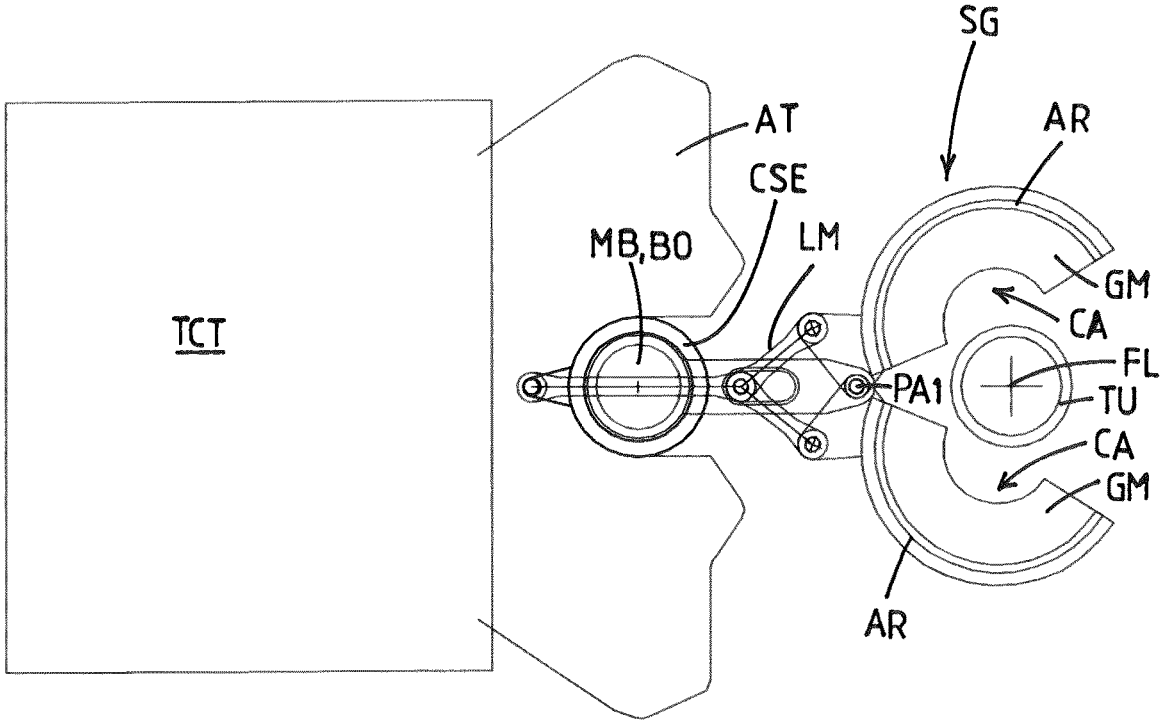
Figure 5:
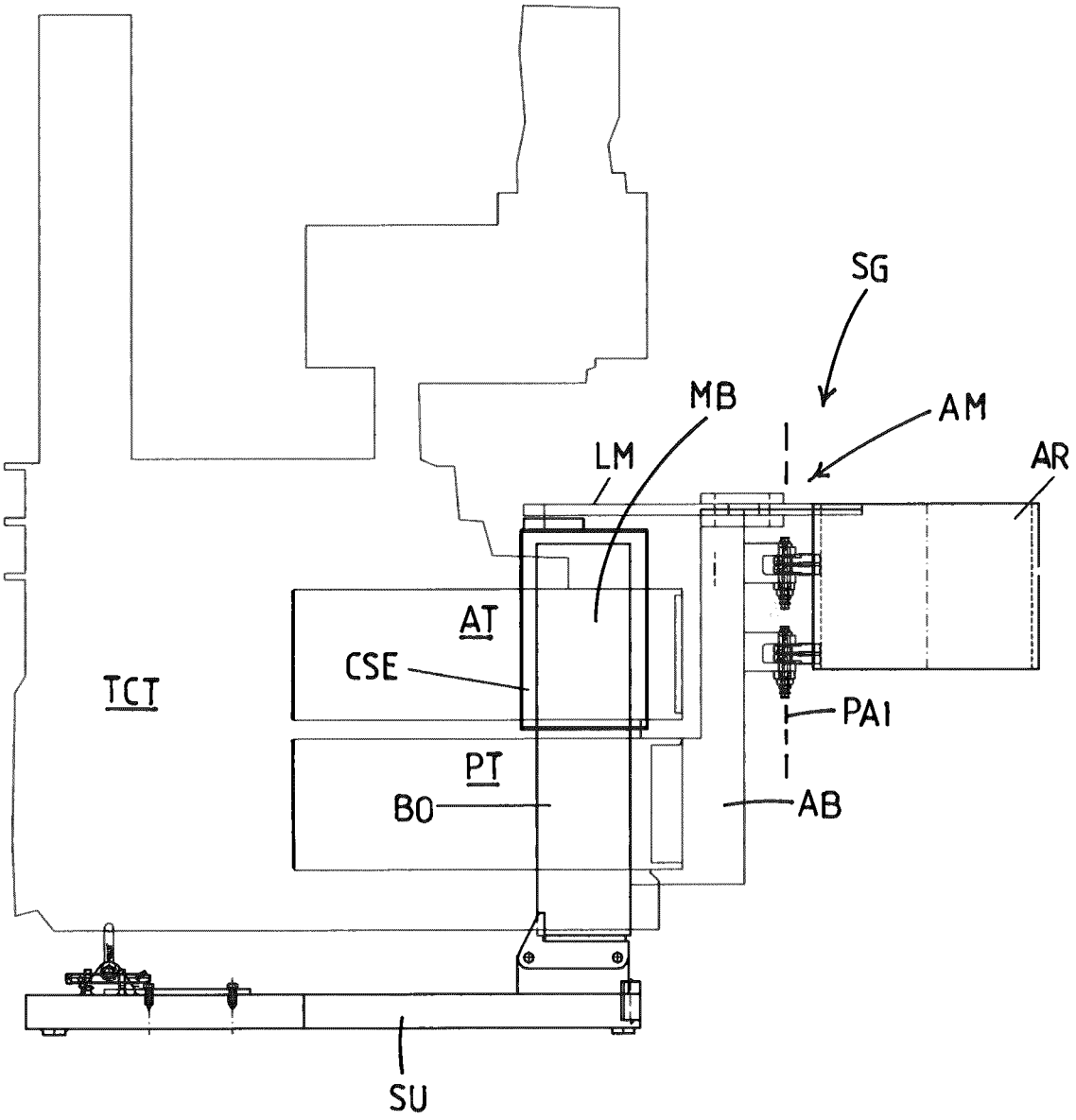
Figure 7:
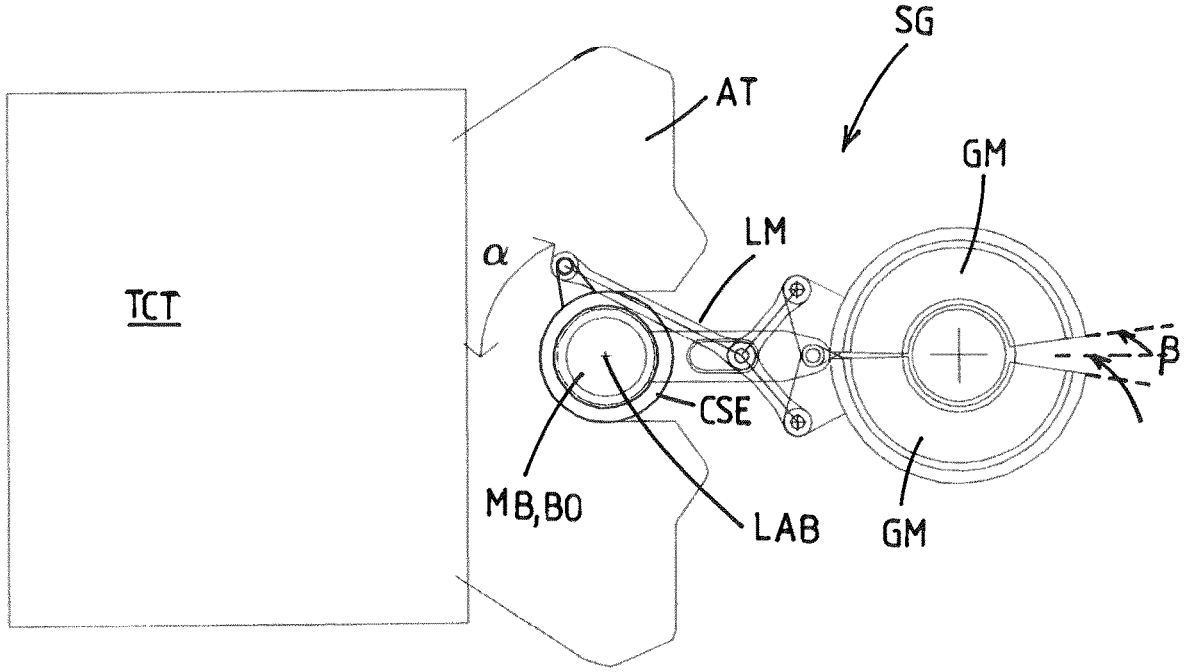

The invention will now be described by reference to the accompanying drawings in which like parts are indicated using like reference symbols, and in which:

FIG. 1 schematically depicts a side view of a stabbing guide according to an embodiment of the invention;

FIG. 2 schematically depicts a side view of the stabbing guide of FIG. 1 held by a tubular connection tool;

FIG. 3 schematically depicts a top view of the stabbing guide of FIG. 1 in the tubular connection tool of FIG. 2 with the guide members in the open position;

FIG. 4 schematically depicts a top view of the stabbing guide of FIG. 1 in the tubular connection tool of FIG. 2 with the guide members in the closed position;

FIG. 5 schematically depicts a side view of a stabbing guide according to another embodiment of the invention in a tubular connection tool;

FIG. 6 schematically depicts a top view of the stabbing guide and the tubular connection tool of FIG. 5 with the guide members in the open position; and FIG. 7 schematically depicts a top view of the stabbing guide and the tubular connection tool of FIG. 5 with the guide members in the closed position.

FIG. 1 schematically depicts a side view of a stabbing guide SG according to an embodiment of the invention. The stabbing guide SG of FIG. 1 is a stabbing guide according to the first aspect of the invention as well as a stabbing guide according to the second aspect of the invention. Although described together, it will be clear to the skilled person that the first and second aspect of the invention do not necessarily need to be combined.

The stabbing guide SG includes a support SU, a body BO, and an actuation mechanism AM that is partially shown in FIG. 1. The other part of the actuation mechanism AM is omitted from FIG. 1 and will be explained below by reference to the FIGS. 3 and 4. The stabbing guide SG also comprises guide members GM that are supported by the body BO via the actuation mechanism AM and which are explained in more detail below by reference to the FIGS. 2-4.

The actuation mechanism AM includes two arms AR that are moveably supported by the body BO. In this embodiment, the moveability is provided by pivotally arranging the arms AR to pivot about a pivot axis PA1.

The body BO in turn is arranged on and connected to the support SU using two bolts B1, B2. In FIG. 1, a longitudinal axis LAB of the body BO extends perpendicular to a longitudinal axis LAS of the support SU. This orientation is referred to as an active orientation. When bolt B2 is removed, bolt B1 provides a pivot axis PA2 for the body BO to pivot counter clockwise in FIG. 1 towards the support SU until the body BO reaches support element SE, which support element SE may include a locking mechanism to temporarily lock the orientation of the body BO, which orientation is characterized by the longitudinal axis LAB being substantially parallel to the longitudinal axis LAS. This orientation is referred to as a transport orientation.

In the transport orientation, the footprint of the stabbing guide SG is relatively small and the stabbing guide fits in a smaller rectangular box than in the active position, thereby being able to be easily transported.

In the active orientation, the body BO is substantially vertical and can be held by a tubular connection tool as will be elucidated below by reference to the FIGS. 2-4. FIG. 1 depicts the stabbing guide SG in the active position with the arms AR of the actuation mechanism extending in a direction opposite to the direction in which the support SU extends from the body BO having the advantage that the weight of the guide members GM when supported by the arms AR may be balanced by the support SU such that when the stabbing guide SG is lifted using a lifting eye LE at an upper end of the body BO, the body BO remains substantially vertical.

FIG. 2 schematically depicts a side view of the stabbing guide SG of FIG. 1 when held by a tubular connection tool TCT. For clarity reasons, the lifting eye LE and the support element SE are omitted in FIG. 2 as is a part of the actuation mechanism AM.

FIG. 3 schematically depicts a top view of the stabbing guide SG of FIG. 1 in the tubular connection tool TCT of FIG. 2 with guide members GM supported by the arms AR in the closed position.

FIG. 4 schematically depicts a top view of the stabbing guide SG of FIG. 1 in the tubular connection tool TCT of FIG. 2 with the guide members GM in the open position.

The tubular connection tool TCT shown in FIG. 2 is in this embodiment hung from a derrick and includes a passive tong PT and an active tong AT. The tubular connection tool TCT can be moved over the drill floor to catch or grab the stabbing guide SG using the passive tong PT and/or the active tong AT. The stabbing guide SG is then lifted by the tubular connection tool TCT, or the stabbing guide SG was lifted prior to catching or grabbing, so that the tubular connection tool TCT is able to move the stabbing guide SG relative to the drill floor with the support SU extending below the tubular connection tool TCT. In FIG. 2, the contours of a spinner SP are visible, however, in this embodiment, the spinner SP has no relationship with the function and operation of the stabbing guide SG.

FIG. 3 and FIG. 4 depict a part of the actuation mechanism AM that is not visible in FIGS. 1 and 2, namely the provision of two hydraulic actuators HA1, HA2 between the respective arms AR and a bracket BR attached to the body BO. Actuation of the hydraulic actuators HA1, HA2 will allow rotation of the arms AR and thus the guide members GM about the pivot axis PA1 between an open position as shown in FIG. 3 allowing to pass and receive a tubular TU in a firing line FL that will fit into the cutaways CA of the guide members GM that have the shape in plan view of a circle sector, and a closed position as shown in FIG. 4 in which the guide members engage with the tubular TU to guide the male connection of another tubular into alignment with the female connection of the tubular TU while protecting the end surface and threads from damage.

The cutaway CA in the guide members GM can also be seen in FIG. 2, see dashed lines. The cutaway CA has an upper portion UCA and a lower portion LCA. The lower portion LCA has a cylindrical shape matching a tubular TU of a specific diameter. In the closed position the lower portion LCA surrounds and rests on the tubular TU, while the upper portion UCA extends above the tubular TU and diverges to a larger diameter at the top to receive and guide the male connection of the tubular to be connected to the tubular TU in alignment with the tubular TU while protecting the end surface of the tubular TU and the threads of both tubulars.

Due to the fact that the guide members GM are supported on the arms AR of the actuation mechanism AM, they can easily be replaced by other guide members when working with tubulars of a different diameter. To this end, the guide members GM are preferably releasably connected to the arms AR. Also preferably, a locking mechanism is provided to lock the guide members GM to the actuation mechanism AM during use, so that the guide members GM do not inadvertently release from the actuation mechanism AM during operation thereof.

FIGS. 5-7 schematically depict another embodiment of a stabbing guide SG according to the invention which stabbing guide SG in this embodiment is used with the same or a similar tubular connection tool TCT. FIG. 5 schematically depicts a side view, FIG. 6 depicts a top view with the guide members GM in the open position, and FIG. 7 depicts a top view with the guide members GM in the closed position.

The main difference between the two embodiments is that the embodiment of FIGS. 1-4 depicts a stabbing guide with integrated actuators, wherein the active and/or passive tongs of the tubular connection tool are only used to hold the body, where the embodiment of FIGS. 5-7 depicts a stabbing guide in which no actuators are provided on the stabbing guide, but the actuation mechanism is actuated using the active tong of the tubular connection tool as will be explained below in more detail.

As shown in FIG. 5, the stabbing guide SG comprises a support SU supporting a body BO, which body BO has a mainly tubular shaped main body MB. A lower part of the main body MB is configured to be held by the passive tong PT. Extending from the lower part of the main body MB is an auxiliary body AB, which auxiliary body AB is configured to support a part of the actuation mechanism AM, including the arms AR that are pivotable about a pivot axis PA1.

The actuation mechanism AM further includes a circular shaped element CSE (the circular shape is clearly visible in plan view, see FIGS. 6 and 7) arranged around an upper part of the tubular shaped main body MB and configured to engage with the active tong AT. The actuation mechanism AM further includes a link mechanism LM between the element CSE and the arms AR to transfer rotational movement of the element CSE to movement of the arms AR and thus of the guide members supported by the arms AR between an open position as shown in FIG. 6 and a closed position as shown in FIG. 7.

In FIG. 7, the arrow near the circular shaped element CSE indicates an angle α that the active tong AT has to rotate the circular shaped element CSE between the open and closed positions. The link mechanism LM can be used to magnify this angle, so that the arms AR and thus the guide members GM are rotated over a larger angle about pivot axis PA1 then the circular shaped element CSE is rotated about the longitudinal axis LAB of the main body MB.

Also shown by reference to FIG. 7, but also present in the embodiment of FIGS. 1-4, is that the guide members GM span an angular range of 180 degrees minus angle β, wherein angle β may be 1, 2, 5 or 10 degrees. In other words, the angle β may be in the range of 0-90 degrees, preferably in the range of 2-60 degrees, more preferably in the range of 5-45 degrees.

The invention claimed is:

1. A method for preparing a threaded connection between an upper tubular having a male threaded lower end and a lower tubular having a female threaded upper end, wherein a tubular connection tool is provided having an active tong that is configured to clamp the upper tubular and to supply a torque to the upper tubular, and having a passive tong that is configured to clamp the lower tubular and to supply a reaction torque to the lower tubular, and wherein a stabbing guide is provided, the stabbing guide comprising:

a body that is configured to be clamped by at least one of the active tong and the passive tong of the tubular connection tool;

a plurality of guide members moveably supported by the body of the stabbing guide and movable between an open position and a closed position; and an actuation mechanism configured to be operated to move the plurality of guide members between the open position and the closed position, wherein the method comprises:

clamping the body of the stabbing guide by at least one of the active tong and the passive tong of the tubular connection tool so that the stabbing guide is held by the tubular connection tool;

operating the actuation mechanism of the stabbing guide to move the guide members into the open position;

using the tubular connection tool to move the stabbing guide held by the tubular connection tool to a position such that the guide members, while being in the open position thereof, surround the female threaded end of the lower tubular;

operating the actuation mechanism to move the guide members to the closed position; and stabbing the lower end of the upper tubular into the upper end of the lower tubular, said lower end being guided by the guide members of the stabbing guide in the closed position thereof.

2. The method according to claim 1, wherein the method further comprises making the threaded connection, comprising, after the stabbing of the lower end of the upper tubular into the upper end of the lower tubular:

operating the actuation mechanism of the stabbing guide to move the guide members into the open position;

using the tubular connection tool to move the stabbing guide held by the tubular connection tool, while the guide members are in the open position thereof, away from the female threaded end of the lower tubular;

releasing the clamping of the body of the stabbing guide by the at least one of the active tong and the passive tong of the tubular connection tool so that the stabbing guide is no longer held by the tubular connection tool; and operating the tubular connection tool so that the active tong clamps the upper tubular and the passive tong clamps the lower tubular and operating the active tong to supply the torque to the upper tubular and operating the passive tong to supply a-the reaction torque to the lower tubular.

3. The method according to claim 1, wherein the actuation mechanism of the stabbing guide includes a portion that is engaged by the tubular connection tool such that actuation of the active tong of the tubular connection tool causes the plurality of guide members to move between the open position and closed position via the actuation mechanism of the stabbing guide.

4. The method according to claim 1, wherein the body of the stabbing guide is a tubular body that is clamped by the passive tong of the tubular connection tool, and wherein a circular shaped element of the stabbing guide is rotatably arranged around the tubular body, the circular shaped element being clamped by the active tong of the tubular connection tool, and wherein the actuation mechanism of the stabbing guide is configured to transfer a rotational movement of the circular shaped element caused by operating the active tong into movement of the plurality of guide members between the open position and the closed position.

5. The method of claim 1, wherein the stabbing guide comprises a support that is configured to position the stabbing guide on a flat surface when the stabbing guide is not held by the tubular connection tool.

6. The method of claim 1, wherein the body of the stabbing guide that is clamped by the at least one of the active tong and the passive tong of the tubular connection tool has a tubular shape.

7. The method of claim 1, wherein the stabbing guide is provided with two guide members, each guide member being pivotable about a respective pivot axis between the open position and the closed position.

8. The method of claim 1 wherein the stabbing guide is provided with two guide members, each guide member being pivotable about a respective pivot axis between the open position and the closed position, wherein the pivot axes of the two guide members coincide.

9. The method of claim 1, wherein the stabbing guide is provided with two guide members, each guide member being pivotable about a respective pivot axis between the open position and the closed position, wherein the two guide members have a shape corresponding to a circle sector with a cutaway for receiving a portion of the lower tubular and the upper tubular.

10. The method of claim 1, wherein the guide members are releasably connected to the actuation mechanism to allow the guide members to be replaced by another set of guide members corresponding to a different tubular diameter.

* * * * *